US008550048B2

(12) United States Patent
Stifel et al.

(10) Patent No.: US 8,550,048 B2
(45) Date of Patent: Oct. 8, 2013

(54) CORONA IGNITION DEVICE

(71) Applicants: Timo Stifel, Korntal-Muenchingen (DE); Thomas Giffels, Stuttgart (DE)

(72) Inventors: Timo Stifel, Korntal-Muenchingen (DE); Thomas Giffels, Stuttgart (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 0 days.

(21) Appl. No.: 13/654,934

(22) Filed: Oct. 18, 2012

(65) Prior Publication Data

US 2013/0199484 A1 Aug. 8, 2013

(30) Foreign Application Priority Data

Oct. 21, 2011 (DE) ..... 10 2011 054 681

(51) Int. Cl.
*F02P 23/00* (2006.01)

(52) U.S. Cl.
USPC ..... 123/143 B; 313/141; 313/143

(58) Field of Classification Search
USPC ..... 123/143 B; 313/141, 143
See application file for complete search history.

(56) References Cited

U.S. PATENT DOCUMENTS

| | | | | |
|---|---|---|---|---|
| 6,590,318 | B2 * | 7/2003 | Nishikawa et al. | 313/143 |
| 6,883,507 | B2 | 4/2005 | Freen | |
| 2007/0159047 | A1 * | 7/2007 | Ishinada | 313/143 |
| 2010/0282197 | A1 * | 11/2010 | Permuy et al. | 123/143 B |
| 2011/0247579 | A1 * | 10/2011 | Hampton et al. | 123/146.5 R |
| 2011/0253089 | A1 * | 10/2011 | Braeuchle et al. | 123/143 B |
| 2011/0297132 | A1 | 12/2011 | Scremmer et al. | |
| 2012/0279468 | A1 * | 11/2012 | Burrows et al. | 123/143 B |
| 2013/0003251 | A1 * | 1/2013 | Durham et al. | 361/253 |
| 2013/0049566 | A1 * | 2/2013 | Burrows et al. | 313/141 |

FOREIGN PATENT DOCUMENTS

| | | | |
|---|---|---|---|
| EP | 1 515 594 | A2 | 3/2005 |
| WO | WO 2010/009489 | A1 | 1/2010 |
| WO | WO 2010/081153 | A2 | 7/2010 |

* cited by examiner

*Primary Examiner* — Erick Solis

(57) ABSTRACT

What is described is a corona ignition device for igniting fuel in an internal combustion engine by generating a corona discharge, said corona ignition device comprising a housing, an insulator, which is held in the housing, a center electrode, which is held in the insulator, and at least one ignition tip at an and of the center electrode. The housing surrounds an interior, which has a cylindrical portion in which a cylindrical portion of the insulator sits. A widened interior portion adjoins at the end of the cylindrical interior portion remote from the ignition peak. The insulator has a thinner portion in the widened interior portion. The cylindrical portion of the insulator carries an electrically conductive coating, which ends before the thinner portion.

14 Claims, 1 Drawing Sheet

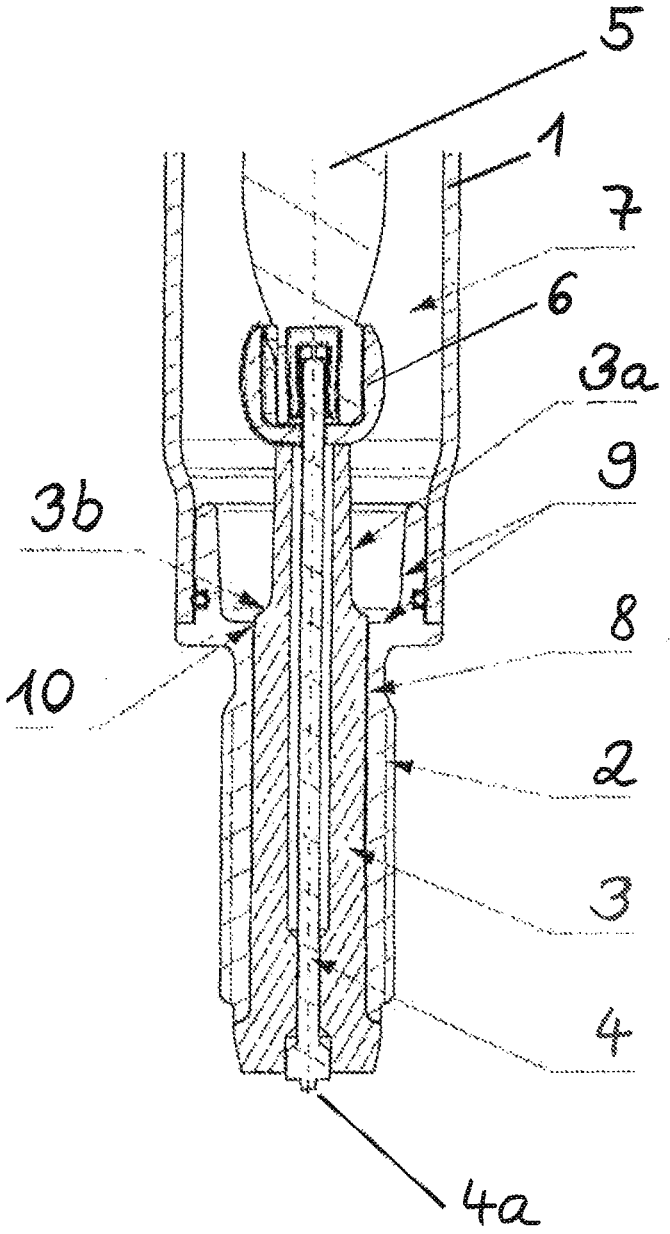
5
1
7
6
3a
9
3b
8
10
2
3
4
4a

CORONA IGNITION DEVICE

The invention relates to an ignition device having the features listed in the preamble of claim 1. Ignition devices of this type are referred to as corona ignition devices or HF ignition devices and are known for example from EP 1 515 594 A2.

A method for igniting fuel in a combustion chamber of an internal combustion engine by a corona discharge generated in the combustion chamber is also described in US 2004/0129241 A1. Therein, a centre electrode is used that is held in an insulator body which is surrounded by an outer conductor. The outer conductor or the walls of the combustion chamber, which are at earth potential, act as a counter electrode. The centre electrode, insulator body and the outer conductor or the walls of the combustion chamber form a capacitor. The insulator surrounding the centre electrode and the combustion chamber with its contents act as a dielectric. Depending on the stroke in which the piston is located, air or a fuel/air mixture or an exhaust gas is located in said combustion chamber.

This capacitor forms part of an electrical resonating circuit, which is excited by a high-frequency voltage. The resonance frequency of the resonating circuit is typically between 30 kilohertz and 10 megahertz, and the alternating voltage at the ignition electrode usually reaches values of 15 kV to 500 kV for example. A corona discharge can thus be generated in the combustion chamber.

In the case of the corona ignition devices known from US 2004/0129241 A1 and EP 1 515 594 A2, the centre electrode ends in a single ignition tip. The centre electrode may also branch into a plurality of ignition tips, however, so as to generate a plasma in a larger volume.

The housing of corona ignition devices is normally composed of a housing tube and a housing head, which is mounted in a gastight manner in the cylinder head of an internal combustion engine and for this purpose generally, has an outer thread. The housing head surrounds a cylindrical portion of the insulator so as to rest theregainst tightly. There are severe changes of the electrical field in the transition from the tube housing to the narrower housing head. This transition has previously proven to be problematic and susceptible to high-voltage breakdown or partial discharges.

Corona ignition devices are an alternative to conventional ignition systems, which cause ignition by means of an arc discharge at a spark plug and are subject to considerable wear as a result of electrode burn-off. Corona ignition devices have the potential of a longer service life, although this has only been fulfilled previously only to a limited extent, since high-voltage breakdown or partial discharges often lead to premature failure.

An object of the invention is therefore to present a way in which the service life of a corona ignition device can be improved.

SUMMARY OF THE INVENTION

This object is achieved by an ignition device having the features of claim 1. Advantageous refinements of the invention are disclosed in the dependent claims.

A rear portion of the insulator remote from the combustion chamber has proven to be particularly critical for voltage breakdown and internal partial discharges. The housing of the corona ignition device has a greater inner diameter at this tip than at its front end facing the combustion chamber. The housing surrounds the rear portion of the insulator at a considerable distance, whilst a front housing part that is sometimes referred to as a housing head and generally has an outer thread rests tightly against the insulator.

In a corona ignition device according to the invention, the insulator has a thinner portion in a widened interior portion of the housing. Although a lower breakdown strength would be expected as a result of a thinner insulator, the susceptibility of the corona ignition device to voltage breakdown and partial discharges can surprisingly be reduced considerably by this design of the insulator.

The centre electrode forms a capacitance with an electrically conductive surface surrounding the insulator. This surface is at a greater distance from the thinner portion of the insulator than from the cylindrical portion of the insulator. The electrically conductive surface may be the inner surface of the housing, a metallic part inserted in the housing and/or an electrically conductive coating of the insulator. For example, a portion of the electrically conductive surface may be an electrically conductive coating covering the cylindrical portion of the insulator, and another portion of the electrically conductive surface may be the portion of the housing surrounding the thinner insulator portion.

The thinner portion of the insulator may be shaped in the manner of the frustum of a cone and may directly adjoin a cylindrical insulator portion, which is enclosed tightly by the housing. In accordance with an advantageous refinement of the invention, the insulator may have a tapering portion between the cylindrical insulator portion and the insulator portion. Between the cylindrical insulator portion, which is arranged in the cylindrical interior section of the housing, and the thinner insulator portion, which is arranged in the widened interior portion of the housing, the diameter of the insulator decreases continuously. The thinner insulator portion may then be formed cylindrically or may taper further towards the end of the insulator remote from the combustion chamber. The tapering portion is preferably conical or concavely rounded. This means that when the insulator is viewed in longitudinal section, the tapering portion has a concave curvature, that is to say a curvature curved inwardly toward the insulator.

The cylindrical portion of the insulator carries an electrically conductive coating, which ends before the thinner portion. The electrical coating thus covers the cylindrical insulator portion, but not the thinner portion. The electrically conductive coating preferably extends only as far as the rear end of the cylindrical insulator portion. Should the insulator have a transition region, this may be covered completely or in part by the electrically conductive coating, but is preferably uncovered. The rear end of the cylindrical insulator portion is the end that faces the thinner insulator portion. The electrically conductive coating preferably consists of metal or an electrically conductive ceramic, for example molybdenum silicide.

According to an advantageous refinement of the invention, the cylindrical insulator portion may end flush with the cylindrical interior portion or protrude from the cylindrical interior portion of the housing to the rear, that is to say away from the ignition tip(s). It is also possible that the cylindrical portion of the insulator may already end in the cylindrical interior portion of the housing, but a higher breakdown strength can be achieved if the cylindrical insulator portion extends at least as far as the rear end of the cylindrical interior portion of the housing, that is to say at least as far as the end of the cylindrical interior portion remote from the combustion chamber. If the cylindrical insulator portion protrudes slightly from the cylindrical interior portion, this facilitates the manufacturing process. The cylindrical insulator portion should preferably protrude from the cylindrical interior portion by less than its radius, more preferably by less than half of its radius, in particular by less than a third of its radius.

According to another advantageous refinement of the invention, the thinner insulator portion may be longer than its smallest diameter. The thinner insulator portion is preferably even longer than the diameter of the cylindrical insulator portion. The risk of high-voltage breakdown or partial discharges can indeed also be reduced considerably with a shorter thinner insulator portion, but, with a longer thinner insulator portion, the electrical connection of the feed line, often referred to as a centre electrode, of the ignition tip can be placed in a region of the housing, which is so far removed from critical regions in which the inner diameter of the housing changes radically that the risk of high-voltage breakdown or partial discharges is largely avoided.

According to another advantageous development of the invention, each geometrical cone that is tangent to the insulator in the transition region may have an angle of aperture of 140° or less, preferably 120° or less, in particular less than 110°. This cone is a straight geometrical cone, that is to say it is rotationally symmetrical about an axis extending perpendicular to its base area. The angle of aperture of such a cone is twice the angle enclosed between this axis and the conical surface. The angle of aperture of such a cone is defined by tangents. An angle of 140° and less ensures that the thickness of the insulator does not change abruptly or suddenly. Peaks of the electric field can thus be largely avoided or at least attenuated.

According to another advantageous refinement of the invention, the interior of the housing may widen in a stepped manner at the end of the cylindrical interior portion remote from the ignition tip. This also contributes to an increase in breakdown strength.

Accordance to another advantageous refinement of the invention, the thinner portion of the insulator is embedded in electrically insulating filler, for example ceramic powder or casting compound. Filler material surrounding the thinner portion of the insulator can advantageously increase breakdown strength.

BRIEF DESCRIPTION OF THE DRAWINGS

Further details and advantages of the invention will be explained on the basis of an illustrative embodiment with reference to the accompanying drawing, in which:

FIG. 1 shows a longitudinal section of a front part of an embodiment of a corona ignition device according to the invention.

DETAILED DESCRIPTION

The corona ignition device illustrated in FIG. 1 is used to ignite fuel in a combustion chamber of an internal combustion engine. The corona ignition device has a housing, which is composed of a housing tube 1 and a housing head 2. The housing head 2 can be fixed to the housing tube 1, for example by welding or soldering. Housing tube 1 and the housing head 2 may be fitted one inside the other in order to facilitate connecting them. The housing head 2 has an outer thread for screwing into a cylinder head of an engine. Other means, such as plug connections, can be used instead of a thread to fasten a corona ignition device to a cylinder head in a gastight manner.

An insulator 3 is held in the housing. The insulator 3 surrounds a centre electrode 4, which ends in an ignition tip 4*a*. In the embodiment shown, only a single ignition tip is provided. However, it is also possible for the centre electrode to branch and carry a plurality of ignition tips 4*a*. The centre electrode 4 is connected at its rear end to a coil 5. This coil 5 is part of an electrical resonating circuit, as is a capacitor formed by the centre electrode 4 and the housing head 2, the dielectric of said capacitor being the insulator 3. The resonating circuit is excited during operation by a high-frequency voltage so as to generate a high voltage at the ignition peak 4*a* of 30 kV or more, for example. The high voltage thereby causes a corona discharge to arise from the ignition peak 4*a*.

As shown in FIG. 1, the housing head 2 surrounds a cylindrical interior, in which a cylindrical portion of the insulator 3 sits. A widened interior portion of the housing adjoins this cylindrical interior portion of the housing. The insulator 3 has a thinner portion 3*a* in the widened interior portion. The diameter of the insulator diminishes continuously from the diameter of the cylindrical portion to a smaller diameter in the widened interior portion of the housing.

The thinner portion of the insulator 3 is thinner than the cylindrical insulator portion that is arranged in the cylindrical interior portion of the housing. The cylindrical insulator portion protrudes slightly at its rear end from the cylindrical interior portion of the housing, e.g. by less than half its radius.

In the cylindrical interior portion, the cylindrical insulator portion touches the housing. In the widened interior portion, the housing surrounds the insulator in a distance. There is an annular space in the widened interior portion. The annular space may be empty or filled with an electrically insulating filler 7. The thinner portion of the insulator thus is placed at a larger distance from a surrounding electrically conductive surface than the cylindrical portion of the insulator. The centre electrode 4 forms a capacitance with this surrounding surface. The surrounding surface may be provided by the housing, an electrically conductive layer covering the insulator, and/or a metallic part placed inside the housing.

The thinner insulator portion 3*a* extends from the housing head 2 up to a connection element 6, via which the centre electrode 4 is connected to the coil 5. The insulator 3 has a tapering portion 3*b* between the cylindrical insulator portion and the thinner insulator portion 3*a*, which may be tapering or cylindrical. The tapering portion may be concavely rounded or conical. The tapering portion 3*b* adjoins the cylindrical insulator portion on one side and the thinner portion on the other. Inside the widened interior portion of the housing, the insulator nowhere has a larger thickness than in the cylindrical section.

The thinner insulator portion 3*a* and the tapering portion 3*b* are surrounded by filler 7, for example by electrically insulating ceramic powder, with which the housing tube 1 is filled. The thinner portion 3*a* is embedded in the filler 7. The electrically insulating filler 7 touches the thinner portion 3*a* along its entire length.

The thinner portion is an end section of the insulator. The insulator has its biggest diameter in an end section placed at the other end of the insulator 3. The insulator 3 may protrude from the front side of the housing into the combustion chamber or end flush with the housing. If the insulator 3 protrudes from the housing, the protruding portion may be thicker than the adjoining cylindrical portion.

The cylindrical insulator portion carries an electrically conductive coating 8, for example made of electrically conductive ceramics or metal. The electrically conductive coating 8 does not cover the thinner portion 3*a*. The electrically conductive coating ends at the rear end of the cylindrical insulator portion. The electrically conductive coating 8 preferably covers only the surface of the insulator 3 where the insulator 3 touches the housing head 3. The other regions of the insulator 3 are free from the electrically conductive coating 8.

Each geometrical cone that is tangent to the insulator 3 in the transition region should have an angle of aperture of less than 140°; of less than 120°. The reduction in diameter of the insulator 3 is thus implemented in an expanded tapering portion so that field peaks are largely avoided or at least reduced.

Whereas the insulator 3 tapers gradually, the interior of the housing at the rear end of the cylindrical interior portion, in which the cylindrical insulator portion is held, may expand in a stepped manner, that is to say may widen abruptly. In the embodiment shown, the housing body 2 has an annular area 9, which is oriented perpendicular to the longitudinal axis of the insulator.

Although edges and sudden changes in size increase the risk of field peaks and thus of voltage breakdown, the housing may have an edge 10 on its inner face at the rear end of the cylindrical interior portion. In fact, such an edge 10 even appears to be advantageous, since it leads to the quickest possible increase in the distance between the insulator 3 and the housing.

In the embodiment described, a course of the field lines in the insulator 3 is achieved starting from the combustion chamber side with minimal deflection in the transition region, in which the interior expands. The field concentrations at the edge 10 of the housing head 2 and any edge of the insulator 3 at the rear end of the cylindrical insulator portion are therefore advantageously low.

REFERENCE NUMBERS

1 housing tube
2 housing head
3 insulator
3*a* thinner insulator portion
3*b* tapering portion of the insulator
4 centre electrode
4*a* ignition tip
5 coil
6 connection element
7 filler
8 coating
9 annular area

What is claimed is:

1. A corona ignition device for igniting fuel in an internal combustion engine by generating a corona discharge, said corona ignition device comprising a housing, an insulator, which is held in the housing, a centre electrode, which is held in the insulator, and at least one ignition tip at an end of the centre electrode, wherein the housing surrounds an interior, which has a cylindrical portion and a widened portion adjoining the cylindrical portion of the interior on an end facing away from the at least one ignition tip, wherein a cylindrical portion of the insulator sits in the cylindrical portion of the interior, wherein the insulator has a thinner portion in the widened portion of the interior, and wherein the cylindrical portion of the insulator carries an electrically conductive coating, which ends before the thinner portion of the insulator.

2. The ignition device according to claim 1, wherein the insulator has a tapering portion between the cylindrical insulator portion and the thinner insulator portion, said tapering portion adjoining the cylindrical insulator portion and the thinner insulator portion.

3. The ignition device according to claim 2, wherein the tapering portion is rounded concavely or is conical.

4. The ignition device according to claim 2, wherein each geometrical cone that is tangent to the insulator in the tapering portion has an angle of aperture of 140° or less.

5. The ignition device according to claim 1, wherein the cylindrical insulator portion protrudes from the cylindrical interior portion into the widened interior portion of the housing or ends flush therewith.

6. The ignition device according to claim 5, wherein the cylindrical insulator portion protrudes from the cylindrical interior portion by less than its radius.

7. The ignition device according to claim 1, wherein the thinner insulator portion (3*a*) is longer than its smallest diameter.

8. The ignition device according to claim 1, wherein the housing has an outer thread, which surrounds the cylindrical interior portion.

9. The ignition device according to claim 1, wherein the interior widens in a stepped manner.

10. The ignition device according to claim 1, wherein the thinner insulator portion is surrounded in the widened interior by an electrically insulating filler material.

11. The ignition device according to claim 1, wherein the insulator protrudes with an end adjacent to the at least one ignition tip from the housing.

12. The ignition device according to claim 11, wherein the electrical coating ends before the end of the insulator adjacent to the at least one ignition tip.

13. The ignition device according to claim 11, wherein the insulator is thicker at the end adjacent to the at least one ignition tip than in the cylindrical insulator portion.

14. The ignition device according to claim 1, wherein the centre electrode forms a capacitance with an electrically conductive surface surrounding the insulator, said surface being at a greater distance from the thinner portion of the insulator than from the cylindrical portion of the insulator.

* * * * *